US010316621B2

(12) United States Patent
Adolph et al.

(10) Patent No.: US 10,316,621 B2
(45) Date of Patent: Jun. 11, 2019

(54) DOWNHOLE TOOL POWER BALANCING

(71) Applicant: Schlumberger Technology Corporation, Sugar Land, TX (US)

(72) Inventors: Robert Arthur Adolph, Pennington, NJ (US); Tadashi Tajima, Sagamihara (JP); Julien Tavernier, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 216 days.

(21) Appl. No.: 15/379,708

(22) Filed: Dec. 15, 2016

(65) Prior Publication Data

US 2018/0171756 A1 Jun. 21, 2018

(51) Int. Cl.
*E21B 41/00* (2006.01)

(52) U.S. Cl.
CPC ..... *E21B 41/00* (2013.01)

(58) Field of Classification Search
CPC ..... E21B 47/1015; E21B 47/18; E21B 41/00; H02J 1/14; H02J 4/00; H05H 3/06; G01V 5/10
See application file for complete search history.

(56) References Cited

U.S. PATENT DOCUMENTS 2,349,225 A * 5/1944 Scherbatskoy ..... G01V 5/04 250/263
2,573,133 A * 10/1951 Greer ..... E21B 47/12 324/366
2,967,245 A * 1/1961 Soloway ..... G01V 5/10 376/111
4,709,234 A * 11/1987 Forehand ..... E21B 47/00 166/66
5,293,410 A 3/1994 Chen et al.
5,960,883 A * 10/1999 Tubel ..... E21B 34/066 166/313
6,703,606 B2 3/2004 Adolph
9,143,026 B2 9/2015 Hiles et al.
2006/0196664 A1* 9/2006 Hall ..... E21B 44/00 166/297
2010/0301774 A1* 12/2010 Chemel ..... H05B 37/029 315/297
2011/0044418 A1* 2/2011 Stubbers ..... H05H 3/06 376/116
2011/0180698 A1* 7/2011 Stephenson ..... H05H 3/06 250/269.1
2011/0247825 A1* 10/2011 Batho ..... E21B 41/0007 166/335

(Continued)

FOREIGN PATENT DOCUMENTS

WO WO-2015095714 A1 * 6/2015 ..... E21B 47/1015

*Primary Examiner* — Jennifer H Gay

(57) ABSTRACT

A system includes a downhole tool having a first load of a plurality of loads that receive power from a system power supply. The downhole tool includes a second load of the plurality of loads configured to receive power from the system power supply. The downhole tool includes control electronics that control a temporal distribution of power delivered from the system power supply to at least the first and second load such that timing of power drawn by the first load is based on timing of power drawn by the second load.

17 Claims, 4 Drawing Sheets

(56) References Cited

U.S. PATENT DOCUMENTS

| | | | | |
|---|---|---|---|---|
| 2011/0309678 | A1* | 12/2011 | Shaw | E21B 17/003 307/31 |
| 2013/0208841 | A1* | 8/2013 | Perkins | G21G 4/02 376/114 |
| 2013/0287159 | A1* | 10/2013 | Okada | G21C 17/00 376/254 |
| 2014/0117048 | A1* | 5/2014 | Brudevold | B67D 99/00 222/146.5 |
| 2015/0107824 | A1* | 4/2015 | Signorelli | E21B 41/0085 166/244.1 |
| 2015/0194871 | A1* | 7/2015 | Hiles | G05F 1/10 250/269.1 |
| 2016/0013647 | A1* | 1/2016 | Liu | H02J 3/14 307/35 |
| 2016/0259353 | A1* | 9/2016 | Morroni | H02M 3/285 |
| 2016/0320520 | A1* | 11/2016 | Hiles | E21B 47/1015 |
| 2018/0171756 | A1* | 6/2018 | Adolph | E21B 41/00 |

* cited by examiner

DOWNHOLE TOOL POWER BALANCING

BACKGROUND

This disclosure relates generally to a downhole tool used for detecting geological formation properties and, more particularly, to power balancing of the downhole tool.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, these statements are to be read in this light and not as admissions of any kind.

To locate and extract resources from a well, a wellbore may be drilled into a geological formation. Downhole tools are placed into the wellbore to identify properties of the downhole environment. For example, a pulsed neutron generator (PNG), which may include a sealed tube, controllable power supplies and high voltage insulation system disposed in a housing, is used, for example, in various types of well logging instruments. The PNG emits bursts of high energy (approximately 14 MeV) neutrons that interact with subsurface formations surrounding a wellbore into which the instrument is inserted. Various types of detectors, e.g., gamma ray detectors, fast neutron detectors, epithermal neutron detectors and thermal neutron detectors may be disposed on the instrument at selected axial distances from the PNG. Numbers of, timing of and/or energy levels of detected neutrons and/or gamma rays may be used to determine selected physical properties of the formations. One example of a PNG tube is described in U.S. Pat. No. 5,293,410 issued to Chen et al., which is incorporated by reference in its entirety.

The PNG may generate a stream of deuterium and tritium (D-T) ions in the neutron generator tube to impact a target. Neutrons are produced from the impact through a nuclear fusion reaction. The PNG may include an ion source having a cathode that emits electrons, which are accelerated toward a grid. Collisions of the electrons with deuterium and tritium may create ions. The PNG may include a filament or reservoir that supplies D-T gas, and an acceleration structure referred to as the accelerator column, in which the ions generated by the ion source may be accelerated by an applied electric field. The high voltage generating the electric field may be generated in a high voltage (HV) power supply. Each of the hardware components of the PNG, such as the filament, the cathode, the grid, the HV power supply, and the like, may draw power at various times from a power system of the PNG, including power supplies for each component. That is, at a given time, some or all of the power supplies may draw different levels of power resulting in unpredictable power surges or decreases in power drawn from the system power supply. For example, at a first point in time, the grid, the cathode, and the filament drive may draw power, and at a second point in time, none of these hardware components may draw power. The system power supply of the downhole tool may have difficulty withstanding variations in power demand of long duration. To address this difficulty, a capacitor bank may be included to smooth energy usage. However, a capacitor bank may be bulky and take up an excessive amount of space in the downhole tool, may increase cost of the PNG, and may include additional circuitry to discharge the capacitor bank and/or to prevent inrush currents, thereby increasing complexity of the PNG.

SUMMARY

Embodiments of the present disclosure are related to downhole tools that have a system power supply that provides power to a number of loads. As described below, each of the loads may include individual power supplies that may each draw power from the system power supply. In an embodiment, the system power supply provides power to a cathode, a filament, a grid, and a high voltage power supply that are part of a downhole pulsed neutron generator used to emit energetic neutrons into the geological formation for a logging tool which acquires data related to properties of the formation based on how the neutrons interact with the formation. The operating temperatures of the filament and the cathode may be regulated using power from the system power supply to provide the required D-T gas pressure and electron flux, respectively. A control system of the downhole tool may control a temporal distribution of power supplied from the system power supply to one or more loads. That is, the control system may control timing in which power is delivered from the system power supply to each load in a specific sequence. Because the filament and the cathode operate using heat and have thermal mass, the filament and cathode may remain at or near a target temperature for a longer duration than durations in which power is drawn from the system power supply. That is, the filament and the cathode may remain heated after the filament and cathode are no longer drawing power from the power supply. By controlling the times when the filament and the cathode draw power from the power supply, the filament and the cathode may remain heated at or near the target temperature for operation while reducing peak total power consumption of the downhole tool. That is, the control system may send signals that cause the system power supply to provide power to the filament when the cathode and the grid are not drawing power, and to provide power to the cathode when the filament and the grid are not drawing power. By separating the timing at which each of the loads draws power, the peak power drawn from the system power supply at any given time may be less than if the loads operate independently of one another, which allows conditions to occur in which all loads may draw power simultaneously, possibly far exceeding the average power consumption.

In a first embodiment, a system includes a downhole tool having a first load that receives power from a system power supply. The downhole tool includes a second load that receives power from the system power supply. The downhole tool includes control electronics that control a temporal distribution of power delivered from the system power supply to at least the first and second load such that timing of power drawn by the first load is based on timing of power drawn by the second load. The timing of power drawn from the first load may be optimized to reduce peak total power consumption.

The temporal distribution of the delivered power is more particularly configured so as to limit the variations over time of the total power drawn from the system power supply.

In a second embodiment, a method includes positioning a downhole tool in a geological formation, and controlling a temporal distribution of power delivered from a system power supply to at least a first and second load such that timing of power drawn by the first load is based on timing of power drawn by the second load.

In a third embodiment, a pulsed neutron generator system includes a first power supply that provides power to loads of the pulsed neutron generator. The pulsed neutron generator system includes a cathode that receives power from the first power supply and emits electrons. The pulsed neutron generator system includes a filament configured to receive power from the system power supply and to supply deuterium and tritium (D-T) gas. The pulsed neutron generator system includes a grid that receives power from the system power supply and to produce ions which are accelerated by a high voltage (HV) towards a target. The pulsed neutron generator system includes control electronics configured to control the cathode to draw power during a first period of time and to control the filament to draw power during a second period of time, separate from the first period of time, while the grid is in an off state.

In a fourth embodiment, a method includes positioning a downhole tool in a geological formation, and controlling power provided from a system power supply to a first load based on power drawn by a second load.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
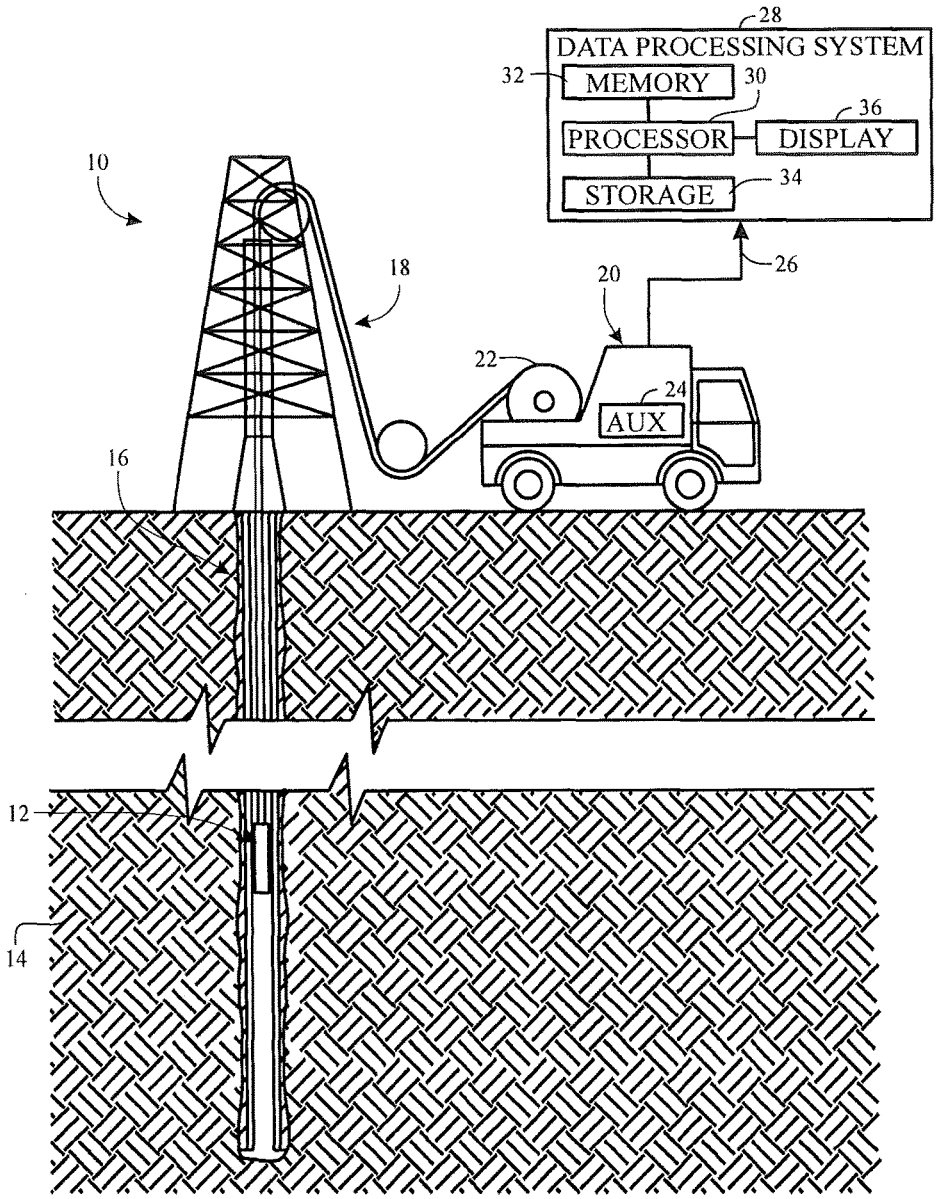
FIG. 1 is a schematic diagram of a wireline system that includes a downhole tool to detect properties of a wellbore or geological formation adjacent to the downhole tool, in accordance with an embodiment.

One or more specific embodiments of the present disclosure will be described below. These described embodiments are examples of the presently disclosed techniques. Additionally, in an effort to provide a concise description of these embodiments, not all features of an actual implementation may be described in the specification. It should be appreciated that in the development of any such actual implementation, as in any engineering or design project, numerous implementation-specific decisions will be made to achieve the developers' specific goals, such as compliance with system-related and business-related constraints, which may vary from one implementation to another. Moreover, it should be appreciated that such a development effort might be complex and time consuming, but would still be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure relates to a downhole tool that measures properties of a geological formation using power balancing. In this disclosure, the downhole tool is described with respect to a pulsed neutron generator (PNG), but the methods and systems described below may apply to any suitable form of downhole tool that uses an accelerator-based radiation generator, such as an X-ray generator, and to other non-radiation pulsed loads (e.g., NMR or acoustic transmitters, EM) with adaptations. For example, the methods and systems may apply to any suitable elements of downhole tools, such as elements that have slower time constants (e.g., thermal or motor speed) compared to faster electrical time constants of the controls. Furthermore, while the downhole tool is described with respect to a wireline conveyance, the downhole tool may be a logging while drilling (LWD) tool, logging while casing tool, through-bit tool, slick-line tool, coiled tubing logging tool, and/or battery supplied downhole tool.

A PNG may include a high voltage supply and a neutron generator tube. The latter may include an ion source for generating ions that are created by collisions of energetic electrons with molecules or atoms of gas produced from a reservoir, or filament. The PNG may include a thermionic material, referred to as the cathode, which, when heated, emits the electrons. Such a cathode may be used for power balancing. The PNG may instead use a cold-cathode ion source such as a Penning-type ion source, which does not require a hot or thermionic cathode. In such case, the filament is used for power balancing. In yet another embodiment the ion source may be an RF or microwave ion source, which may not require a thermionic electron emitter. An applied high voltage accelerates the ions through an electric field from the ion source towards a target to generate neutrons. In some downhole tools, the power supplies of each of the filament, the cathode, the grid, and the HV power supply operate independently of one another. That is, the power supply of the filament may draw power while the power supply of the cathode and/or the grid draws power. The rapid variations (e.g., increases and/or decreases) of varying duration in power drawn from the system power supply may cause stress on the circuitry of the system power supply and/or its power source. As mentioned above, some embodiments may include a capacitor bank to reduce long durations of variations. However, capacitor banks take up additional space in the downhole tool and increase complexity of the PNG and its associated electronics and controls, and may also degrade reliability.

Embodiments of the present disclosure attenuate the increases and/or decreases in power drawn by the PNG by balancing the power provided to each of the power supplies over time. For example, the PNG may include control electronics that controls power provided to the cathode based on the power drawn by the grid and/or the filament. That is, by providing power to a first power supply at a time different than a time in which a second and third power supply are drawing power, the increases and/or decreases in power draw may be reduced. By reducing the power variations, the control electronics may provide peak power closer to average power as compared to power supplies and loads of a downhole tool that operate independently of one another. As such, the capacitor bank may be reduced or eliminated, a size of a power supply filter may be reduced, radiated electromagnetic noise from the power system may be reduced, a power wasting shunt or series regulator may be reduced or eliminated, peak demand on a battery may be reduced, or any combination thereof.

With this in mind, FIG. 1 illustrates a well-logging system 10 that may employ the systems and methods of this disclosure. The well-logging system 10 may be used to convey a downhole tool 12 through a geological formation 14 via a wellbore 16. In the example of FIG. 1, the downhole tool 12 is conveyed on a cable 18 via a logging winch system (e.g., vehicle) 20. Although the logging winch system 20 is schematically shown in FIG. 1 as a mobile logging winch system carried by a truck, the logging winch system 20 may be substantially fixed (e.g., a long-term installation that is substantially permanent or modular). Any suitable cable 18 for well logging may be used. The cable 18 may be spooled and unspooled on a drum 22 and an auxiliary power source 24 may provide energy to the logging winch system 20 and/or the downhole tool 12.

Moreover, while the downhole tool 12 is described as a wireline downhole tool, it should be appreciated that any suitable conveyance may be used. For example, the downhole tool 12 may instead be conveyed as a logging-while-drilling (LWD) tool as part of a bottom hole assembly (BHA) of a drill string, conveyed on a slickline or via coiled tubing, and so forth. For the purposes of this disclosure, the downhole tool 12 may be any suitable measurement tool that uses a detector to obtain measurements of properties of the geological formation 14.

As discussed further below, the downhole tool 12 may emit energy into the geological formation 14, which is detected by the downhole tool 12 as data 26 relating to the wellbore 16 and/or the geological formation 14. The data 26 may be sent to a data processing system 28. The data processing system 28 may be any electronic data processing system that can be used to carry out the systems and methods of this disclosure. For example, the data processing system 28 may include a processor 30, which may execute instructions stored in memory 32 and/or storage 34. As such, the memory 32 and/or the storage 34 of the data processing system 28 may be any suitable article of manufacture that can store the instructions. The memory 32 and/or the storage 34 may be read-only memory (ROM), random-access memory (RAM), flash memory, an optical storage medium, or a hard disk drive, to name a few examples. A display 36, which may be any suitable electronic display, may display the images generated by the processor 30. The data processing system 28 may be a local component of the logging winch system 20 (e.g., within the downhole tool 12), a remote device that analyzes data from other logging winch systems 20, a device located proximate to the drilling operation, or any combination thereof. In some embodiments, the data processing system 28 may be a mobile computing device (e.g., tablet, smart phone, or laptop) or a server remote from the logging winch system 20.

A system power supply of the downhole tool 12 may provide power to various loads of the downhole tool 12. In some embodiments, control electronics of the downhole tool may control the power supplied to the loads of the downhole tool 12 such that the system power supply provides power to each of the loads at different times. For example, the control electronics may provide power to a first load at a time based on power drawn from a second load of the downhole tool 12 such that changes in power are minimized.

Figure 2:
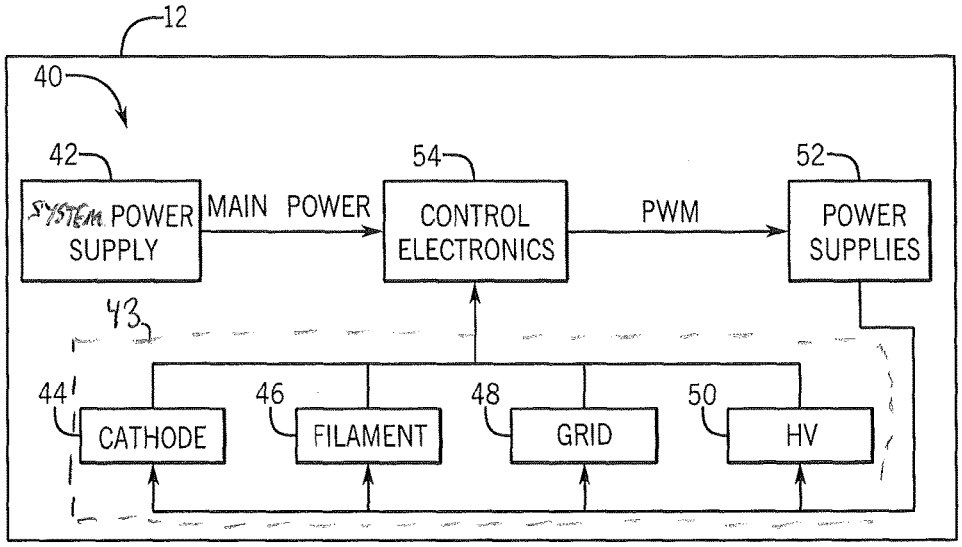
FIG. 2 is a block diagram of the downhole tool of FIG. 1 having a control system that controls power delivered from a system power supply to loads used in detecting the properties of the geological formation or wellbore, each load having a respective power supply, in accordance with an embodiment.

FIG. 2 is a block diagram of a pulsed neutron generator (PNG) system 40 of the downhole tool 12 that powers a pulsed neutron generator (PNG) 43 using, for example, power from the vehicle via the cable 18 or from a battery or hydraulic turbine within the downhole tool 12. The PNG system 40, as described below, may include the PNG as well as other elements, such as a system power supply 42, control electronics 54, and power supplies 52 of each of the loads of the PNG 43. A system power supply 42 of the downhole tool 12 may provide power to sub-power supplies that each power a load of the downhole tool, such as a cathode 44, filament 46, grid 48, and HV power supply 50. The filament 46 may provide a mixture of deuterium and tritium. The cathode 44 may emit electrons into the deuterium and tritium to ionize the deuterium and tritium atoms. The deuterium and tritium ions may then be accelerated in the accelerator column to a target containing the same isotopes via a high voltage (HV) drive 50. Neutrons are produced from the impact through a nuclear fusion reaction. The neutrons may be emitted into the geological formation. Based on the interactions of the neutrons with the geological formation, characteristics of the geological formation and borehole may be determined by the downhole tool 12 or another tool in the vicinity of the downhole tool 12.

The PNG loads, such as the grid and HV power, are pulsed on and off to meet timing requirements of the measurement. Thus, the load on the power supply from the grid and the accelerator will be either at a minimum or maximum depending on the pulse timing sequence. One example of such timing is disclosed by U.S. Pat. No. 6,703,606, entitled "Neutron burst timing method and system for multiple measurement pulsed neutron formation evaluation", which is incorporated by reference herein in its entirety. In this example, the PNG is cycled on about 2000 times (grid being alternatively on and off for generating about 2000 bursts each for about 10 μs) during an active period and is then inactive (i.e. not accelerating ions and not generating bursts) for varying durations (e.g., 25 μs, 400 μs, 7000 μs, etc.) over a 100 ms cycle time. As described below, power balancing redistributes cathode and filament power into grid off times such that the power demand is nearly constant (e.g., less than 10 percent variation in power).

In the illustrated embodiment, the PNG system 40 includes control electronics 54 having circuitry to control the power provided by the system power supply 42 in a manner that reduces rapid increases and/or decreases and their durations. The control electronics 54 may include any suitable circuitry, including analog circuits, microcontrollers, field-programmable gate arrays (FPGA), software, or any combination thereof, to carry out and/or cause to be carried out one or more of the methods described herein. For example, the control electronics 54 may include a processor operatively coupled to a memory to execute instructions for carrying out the presently disclosed techniques. These instructions may be encoded in programs or code stored in a tangible non-transitory computer-readable medium, such as the memory and/or other storage. The memory, in the embodiment, includes a computer readable medium, such as, without limitation, a hard disk drive, a solid state drive, a diskette, a flash drive, a compact disc, a random access memory (RAM), an electrically erasable programmable read-only memory (EEPROM), and/or any suitable storage device that enables the processor to store, retrieve, and/or execute instructions and/or data.

Figure 3:
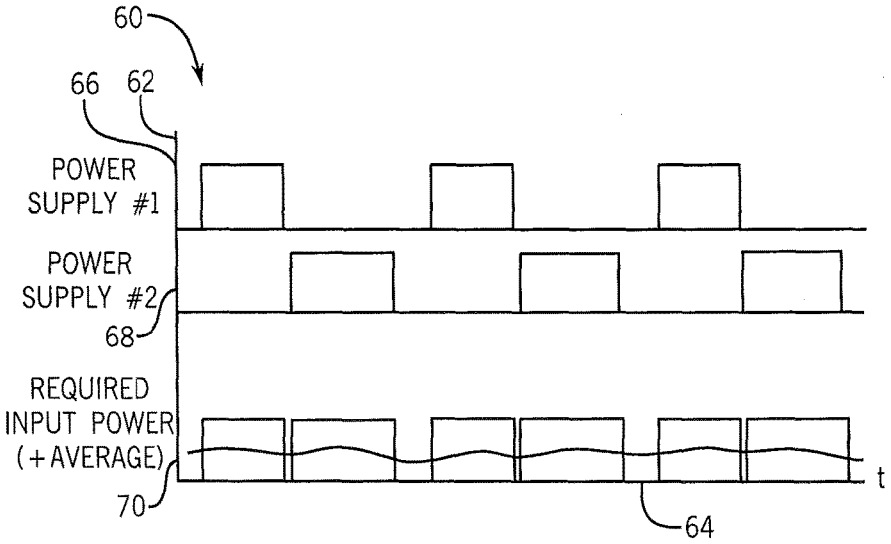
FIG. 3 is a set of graphs of power drawn from the system power supply by the loads of FIG. 2, in accordance with an embodiment.
Figure 4:
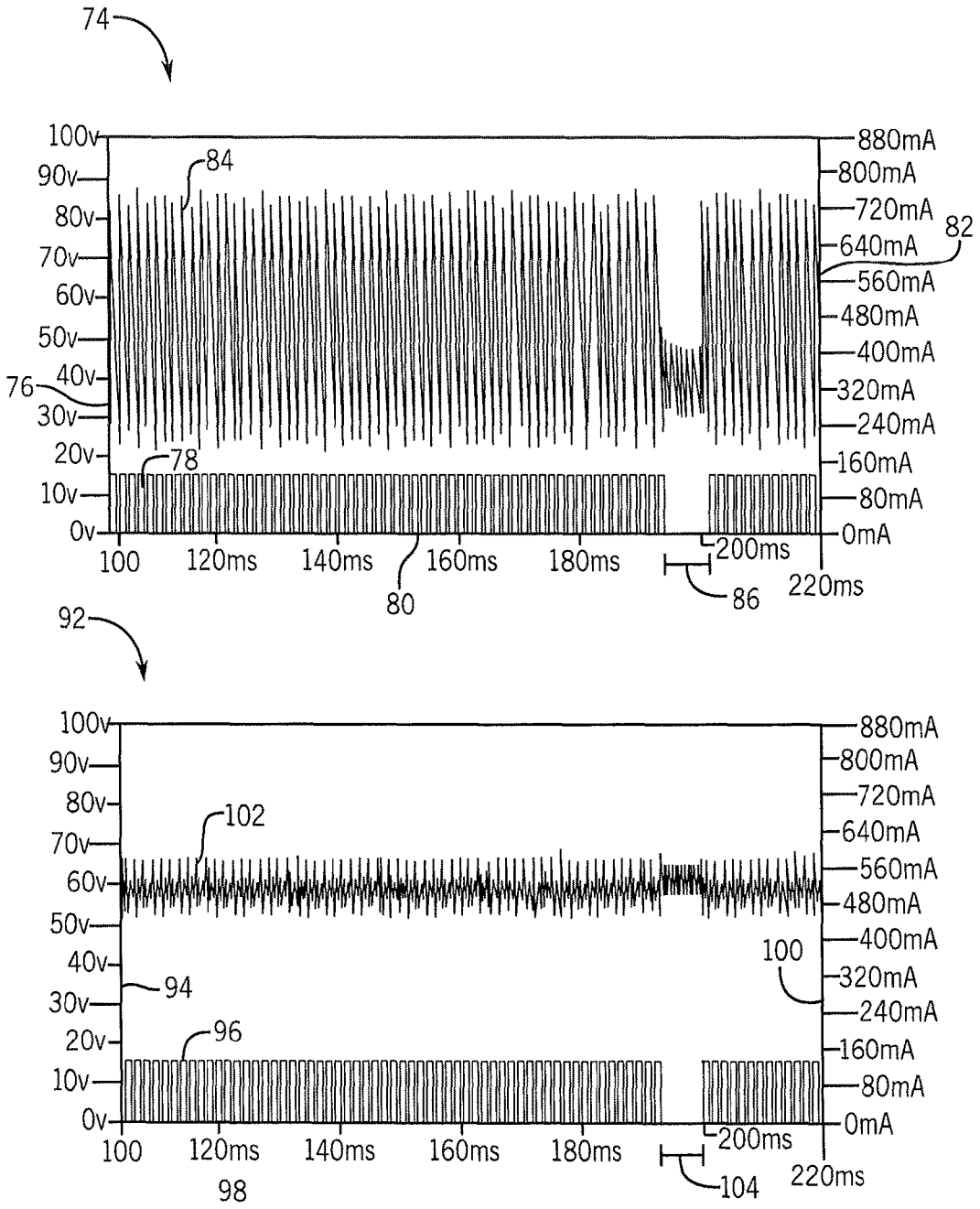
FIG. 4 is a first graph of total current received by the power supplies of the loads without power balancing and a second graph of total current received by the power supplies of the loads with power balancing performed by the control system of FIG. 2, in accordance with an embodiment.
Figure 5:
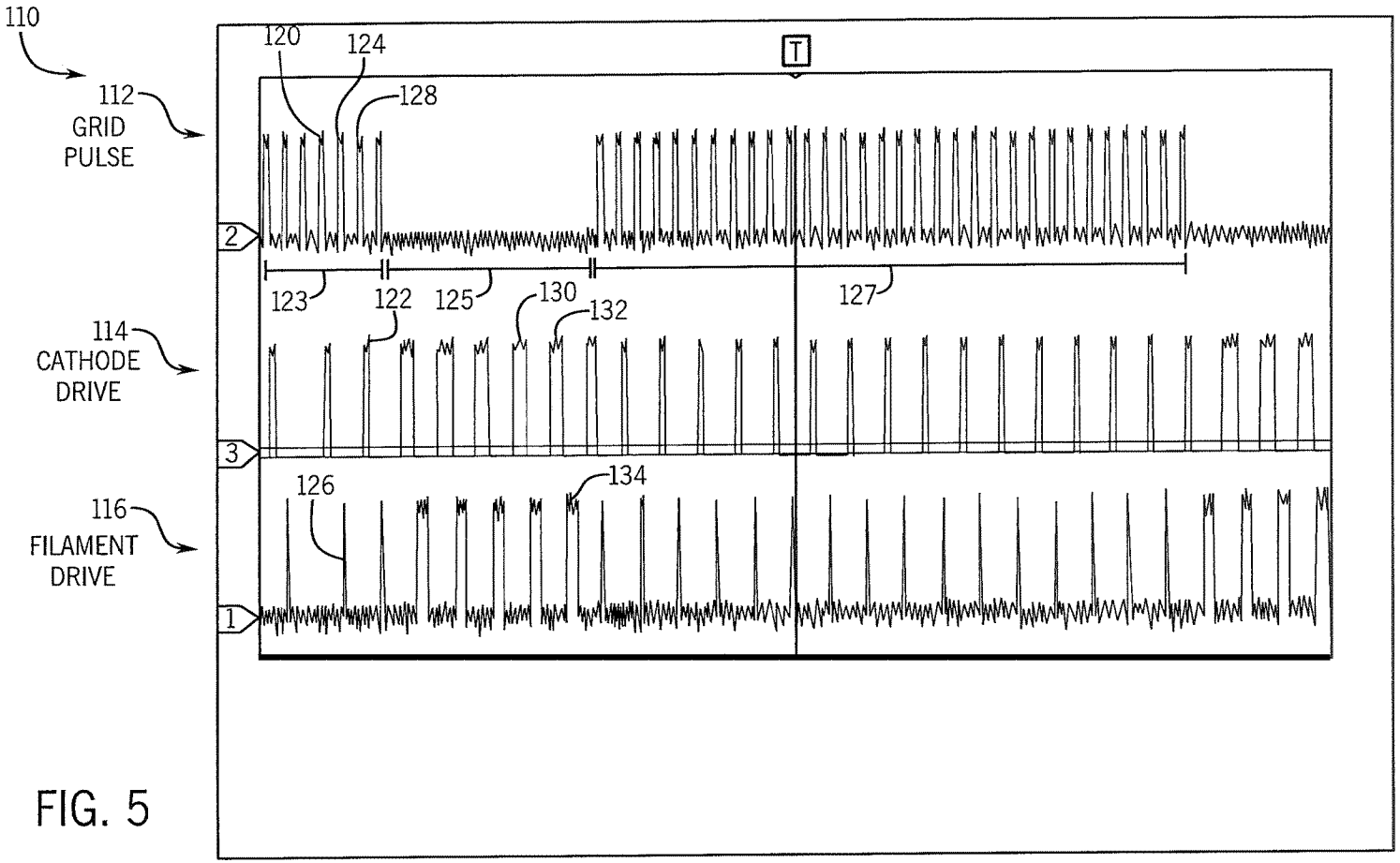
FIG. 5 is a graph of PWM signals from control electronics that controls a temporal distribution of power delivered to the power supplies of each of the loads of FIG. 2, in accordance with an embodiment.

The control electronics 54 may perform a first method of power balancing described with respect to FIG. 3, a second method of power balancing described with respect to FIG. 4, or a combination of both methods as described with respect to FIG. 5. FIG. 3 is a graph 60 of power, shown on the ordinate 62, with respect to time, shown on the abscissa 64. The ordinate 62 includes a first graph 66 that includes power drawn by the first load, in particular a first power supply being part of the first load, a second graph 68 that includes power drawn by the second load, in particular a second power supply being part of the second load, and a third graph 70 that includes power drawn by both the first and second power supplies. Each of the graphs 66, 68, and 70 is aligned with respect to time.

The graph 60 is an example of an illustration of the first method of power balancing to be performed by the control electronics 54. The control electronics 54 may control a temporal distribution of power delivered from the system power supply 42 to the first power supply of the first load based on operation of the second power supply of the second load. For example, the control electronics 54 may control timing at which power is drawn by the cathode to be based on timing of power drawn by the grid. The control electronics may send pulses to cause the power supply of the cathode to draw power at a time period separate from a time period in which the power supply of the grid draws power. While the cathode may be described as the first load and the grid may be described as the second loads in this example, note that each of the loads may include the cathode, filament, grid, or any other suitable loads. Further, while two graphs 66, 68 are shown, this is meant to be illustrative. Indeed, the control electronics 54 may control the timing of power drawn by any suitable number of loads.

In certain embodiments, pulse width modulation (PWM) may be used to set the output parameters of each of the power supplies. Additionally, and/or alternatively, amplitude modulation (AM) may be used to obtain a similar effect. For example, the control electronics may receive a signal indicative of pulses of power drawn by the grid. The control electronics 54 may utilize idle periods of the pulses of power drawn by the grid to control timing of pulses of power drawn by the cathode. Further, the control electronics 54 may receive the grid pulse as a reference. For example, the grid pulse may be derived from host tool timing of the downhole tool 12. The control electronics 54 may provide signals to the power supplies of the cathode 44 and/or filament 46 to insert cathode 44 and filament 46 pulses to draw power during off times of the grid pulses. This may cause the cathode 44 and filament 46 signals to operate at the same frequency. In some embodiments, the HV drive 50 may have an independent frequency that remains unsynchronized with the cathode 44, filament 46, and grid 48 PWM signals.

The cathode 44, the filament 46, the grid 48, and the HV drive 50 may provide feedback to the control electronics 54. For example, the control electronics 54 may control (e.g., via a proportional-integral-derivative (PID) loop to modify the duty cycles of the cathode 44, the filament 46, and the HV drive 50. The control electronics 54 may receive feedback from the cathode 44, the filament 46, the grid 48, and the HV drive 50. Depending on the feedback received, the control electronics may control the each of the respective load power supplies to draw power for the cathode 44, filament 46, or the grid 48. For example, if the control electronics determines that the grid 48 is off and the cathode 44 was heated last, then the control electronics 54 may send signals to the power supply of the filament 46 to cause the filament to draw power from the system power supply 42 while the grid 48 and cathode 44 are off.

FIG. 4 shows a first graph 74 of an embodiment of power provided by the system power supply without power balancing. The first graph 74 includes voltages, shown on the left ordinate 76, of a burst pattern 78 of the downhole tool 12 with respect to time, shown on the abscissa 80. The first graph 74 also includes current, shown on the right ordinate 82, of total input power 84 received by the loads. During an inactive period 86 during which no bursts are generated and ions are not accelerated, the grid may be off for an extended period of time and the HV drive 50 may be reduced because no ions are accelerated. For example, the inactive period 86 may be a time period (e.g., 7 ms of 100 ms) in which the input power 84 decreases as no bursts are generated.

A second graph 92 shows an embodiment of a burst pattern of power provided by the system power supply with power balancing. Similar to the first graph 74, the second graph 92 includes voltages, shown on the left ordinate 94, of a burst pattern 96 of the downhole tool 12 with respect to time, shown on the abscissa 98. The second graph includes current, shown on the right ordinate 100, of total input power 102 received by the loads. During an inactive period 104, the grid 48 may be off and the HV drive 50 power may be greatly reduced because no ions are accelerated and no burst are generated. To balance power and maintain a consistent power usage, the control electronics 54 may send signals to cause the power supplies of the cathode 44 and/or the filament 46 to draw power from the system power supply at a higher level during the inactive period. Since the cathode and filament have a long thermal time constant (e.g., as compared to the time in which the cathode and the filament receive power), short bursts of above average power will be smoothed in these thermal devices, achieving the same effect as average power continuously applied. By balancing the input power 102, the downhole tool 12 may operate with a capacitor bank that is greatly reduced in size or eliminated due to a reduced low frequency (long duration) current ripple of the balanced power.

FIG. 5 shows a graph 110 of input power for various loads of the downhole tool 12. The graph 110 includes a grid PWM sub-graph 112, a cathode PWM sub-graph 114, and a filament PWM sub-graph 116. Each of the sub-graphs are aligned with respect to time. The control electronics 54 may receive a first signal indicating the grid PWM, and the control electronics 54 may take the grid PWM as a reference. The control electronics 54 may determine whether the grid is off. For example, after the grid pulse 120, the grid is in an off state. If the grid pulse is in an off state, the control electronics 54 may determine whether the grid PWM is in the active period or in the inactive period. If the grid is in the active period 123, then the control electronics 54 may provide power to the cathode as indicated by pulse 122 for a first period of time (e.g., to heat the cathode during the first period) such that the cathode remains at or near a target temperature while the grid is in an on state and the cathode is off). The control electronics 54 may then provide power to the grid as indicated by pulse 124. Since the grid 48 is in the active period, the control electronics may determine whether the cathode or the filament 46 was last to receive power. Since the cathode 44 was the last load among cathode 44 and filament 46 to receive power, then the control electronics 54 may send a signal to the power supply of the filament to draw power from the system power supply for a second period of time, as indicated by pulse 126.

By monitoring a grid PWM voltage 130, the control electronics 54 may determine if the grid is in the active period 123 or 127 or the inactive period 125. During the inactive period 125, the control electronics 54 may send a signal to the power supply of the cathode to draw power from the system power supply for a third period of time, longer than the first period of time, as shown by the pulse 130 as compared to pulse 122. After the third period of time, the control electronics 54 may then send a signal to the power supply of the filament to draw power from the system power supply during a fourth period of time, longer than the second period of time, as shown by the pulse 134 as compared to pulse 126. That is, the control electronics may cause the power supplies of the cathode and the filament to draw power for longer durations during the inactive period of the grid as compared to durations during the active period of the grid, thereby reducing fluctuations in total power from all loads for extended periods.

The specific embodiments described above have been shown by way of example, and it should be understood that these embodiments may be susceptible to various modifications and alternative forms. For instance, the method has been disclosed in the previous specification with three loads but the number of loads can be any number greater than one. It should be further understood that the claims are not intended to be limited to the particular forms disclosed, but rather to cover modifications, equivalents, and alternatives falling within the spirit and scope of this disclosure.

What is claimed is:

1. A system, comprising:

a downhole tool, comprising:

a first load of a plurality of loads configured to receive power from a system power supply;

a second load of the plurality of loads configured to receive power from the system power supply; and control electronics configured to control a temporal distribution of power delivered from the system power supply to at least the first and second load such that timing of power drawn by the first load is based on timing of power drawn by the second load, wherein the control electronics is configured to:

receive a first signal indicative of timing of neutron burst production by the second load of the downhole tool; and send a second signal to control power delivered from the system power supply to the first load while the second load is off.

2. The system of claim 1, wherein the first load comprises a cathode of the downhole tool and the second load comprises a grid of the downhole tool, wherein the control electronics is configured to control timing of power drawn by the cathode based on timing of power drawn by the grid.

3. The system of claim 1, wherein the downhole tool comprises a third load configured to receive power from the system power supply, and wherein the control electronics are configured to control timing of power drawn by the third load based on timing at which power is drawn by the first and second loads.

4. The system of claim 3, wherein the third load comprises a filament.

5. The system of claim 1, wherein the control electronics is configured to control power delivered from the system power supply to the first load during a first period of time, different from a second period of time in which power is drawn by the second load.

6. The system of claim 1, wherein the control electronics is configured to send a third signal to cause a third load to draw power from the system power supply while the first load and the second load are off.

7. The system of claim 6, wherein the control electronics is, when a grid of the second load is in an active period in which ions are accelerated, configured to cyclically:

send the second signal to cause the first load to draw power from the system power supply;

send a fourth signal to cause the first load to stop drawing power from the system power supply;

after a duration corresponding to a neutron burst, send the third signal to cause the third load to draw power from the system power supply; and send a fifth signal to cause the third load to stop drawing power from the system power supply.

8. The system of claim 1, wherein the control electronics is configured to:

determine if the second load is in an active period in which ions are accelerated or an inactive period in which ions are not accelerated;

control the first load to draw power for a first duration if the second load is in an active period; and control the first load to draw power for a second duration, longer than the first duration, if the second load is in an inactive period.

9. The system of claim 1, wherein the downhole tool comprises a pulse neutron generator having the first load and the second load.

10. A method, comprising:

positioning a downhole tool comprising a system power supply and a first and second load, wherein the first load comprises a cathode and the second load comprises a grid, in a geological formation; and controlling a temporal distribution of power delivered from the system power supply to at least the first and second load such that timing of power drawn by the first load is based on timing of power drawn by the second load, receiving a feedback signal related to operation of a grid of the second load;

determining whether the grid is in an inactive period in which the system power supply does not provide power to the grid based on the feedback signal; and controlling the system power supply to provide power to the first load for a longer period of time while the grid is in the inactive period than a period of time in which power is provided to the first load while the grid is not in the inactive period.

11. The method of claim 10, comprising controlling timing in which the power is delivered to the first load to be at a time in which the second load is off.

12. The method of claim 10, comprising turning off the power delivered to the first load while the second load is on.

13. The method of claim 10, comprising controlling timing at which power is drawn by the first load based on timing at which power is drawn by a second load and a third load.

14. The method of claim 13, wherein the third load is a filament.

15. A pulsed neutron generator, comprising:

a system power supply configured to provide power to a plurality of loads of the pulsed neutron generator;

wherein the plurality of loads include:

a cathode configured to receive power from the system power supply and to emit electrons;

a filament configured to receive power from the system power supply and to supply deuterium and tritium (D-T) gas;

a grid configured to receive power from the system power supply and to produce ions which are accelerated towards a target; and control electronics configured to control the cathode to draw power during a first period of time and to control the filament to draw power during a second period of time, separate from the first period of time, while the grid is in an off state wherein the control electronics is configured to determine when to provide power to the cathode and the filament by detecting a pattern of when the grid is in an off state.

16. The pulsed neutron generator of claim 15, wherein the control electronics are configured to send a signal to cause the cathode to draw power from the system power supply to heat the cathode during the first period of time such that the cathode maintains heat while the cathode is in an off state.

17. The pulsed neutron generator of claim 15, wherein control electronics inserts pulse width modulation (PWM) drive signals to cause the system power supply to provide power to the cathode and the filament.

* * * * *